United States Patent [19]

Ray

[11] 4,133,679

[45] Jan. 9, 1979

[54] IRON-REFRACTORY METAL-BORON GLASSY ALLOYS

[75] Inventor: Ranjan Ray, Randolph, N.J.

[73] Assignee: Allied Chemical Corporation, Morris Township, Morris County, N.J.

[21] Appl. No.: 866,675

[22] Filed: Jan. 3, 1978

[51] Int. Cl.[2] ..... C22C 38/12; C22C 27/04; C22C 30/00

[52] U.S. Cl. ..... 75/123 B; 75/122; 75/123 J; 75/176

[58] Field of Search ..... 75/122, 123 B, 123 J, 75/176

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 75/122 |
| 3,986,867 | 10/1976 | Masumoto et al. | 75/134 F |
| 4,056,411 | 11/1977 | Chen et al. | 75/122 |
| 4,067,732 | 1/1978 | Ray | 75/128 F |

*Primary Examiner*—Arthur J. Steiner

*Attorney, Agent, or Firm*—Ernest D. Buff; Gerhard H. Fuchs

[57] ABSTRACT

Glassy alloys containing iron and molybdenum or tungsten, together with low boron content, are disclosed. The glassy alloys of the invention consist essentially of about 5 to 12 atom percent boron, a member selected from the group consisting of about 25 to 40 atom percent molybdenum and about 13 to 25 atom percent tungsten and the balance essentially iron plus incidental impurities. The glassy alloys evidence hardness values of at least about 1300 Kg/mm$^2$, ultimate tensile strengths of at least about 420 Kpsi and crystallization temperatures of at least about 600° C.

7 Claims, No Drawings

IRON-REFRACTORY METAL-BORON GLASSY ALLOYS

BACKGROUND OF THE INVENTION

1. Field of the Invention

The invention relates to glassy alloys containing iron and molybdenum or tungsten in conjunction with low boron content.

2. Description of the Prior Art

Chen et al. in U.S. Pat. No. 3,856,513, issued Dec. 24, 1974, have disclosed glassy alloys consisting essentially of about 60 to 90 atom percent of at least one element of iron, nickel, cobalt, vanadium and chromium, about 10 to 30 atom percent of at least one element of phosphorus, boron and carbon and about 0.1 to 15 atom percent of at least one element of aluminum, silicon, tin, germanium, indium, antimony and beryllium. Up to about one-fourth of the metal may be replaced by elements which commonly alloy with iron and nickel, such as molybdenum, titanium, manganese, tungsten, zirconium, hafnium and copper. Chen et al. also disclose wires of glassy alloys having the general formula $T_iX_j$, where T is a transition metal and X is an element selected from the group consisting of phosphorus, boron, carbon, aluminum, silicon, tin, germanium, indium, beryllium and antimony, and where "i" ranges from about 70 to 87 atom percent and "j" ranges from about 13 to 30 atom percent.

More recently, Masumoto et al. have disclosed iron-chromium glassy alloys consisting essentially of about 1 to 40 atom percent chromium, 7 to 35 atom percent of at least one of carbon, boron and phosphorus and the balance iron. Up to about 40 atom percent of at least one of nickel and cobalt, up to 20 atom percent of at least one of molybdenum, zirconium, titanium and manganese and up to about 10 atom percent of at least one of vanadium, niobium, tungsten, tantalum and copper may also be employed. Elements useful for improving mechanical properties include molybdenum, zirconium, titanium, vanadium, niobium, tantalum, tungsten, copper and manganese, while elements effective for improving the heat resistance include molybdenum, zirconium, titanium, vanadium, niobium, tantalum and tungsten.

Efforts to develop new compositions which are easily formed in the glassy state with superior mechanical properties and which at the same time retain high thermal stability are continuing. Substantial amounts of metalloid elements (typically 15 to 25 atom percent) are usually found most suitable for producing the glassy state under reasonable quenching conditions of at least about $10^{5°}$ C./sec, consistent with forming a ductile product. However, such high metalloid content combined with a high refractory metal content also may result in increasing brittleness of the glassy alloy in the as-quenched state.

SUMMARY OF THE INVENTION

In accordance with the invention, substantially totally glassy alloys containing iron and molybdenum or tungsten in conjunction with low boron content are provided. The glassy alloys of the invention consist essentially of about 5 to 12 atom percent boron, a member selected from the group consisting of about 25 to 40 atom percent molybdenum and about 13 to 25 atom percent tungsten and the balance essentially iron plus incidental impurities. The alloys of the invention evidence hardness values of at least about 1300 Kg/mm$^3$, ultimate tensile strengths of at least about 420 Kpsi and crystallization temperatures of at least about 600° C.

DETAILED DESCRIPTION OF THE INVENTION

The glassy alloys of the invention consist essentially of one member selected from the group consisting of about 25 to 40 atom percent (37.7 to 57.7 wt %) molybdenum and about 13 to 25 atom percent (27.7 to 55.8 wt %) tungsten, about 5 to 12 atom percent (0.8 to 2.0 wt % for Mo; 0.8 to 1.6 wt % for W) boron and the balance essentially iron plus incidental impurities. Examples of glassy alloys of the invention include $Fe_{60}Mo_{30}B_{10}$, $Fe_{55}Mo_{35}B_{10}$, $Fe_{77}W_{15}B_8$ and $Fe_{77}W_{13}B_{10}$.

The low boron content and the high refractory metal content are interdependent. When the boron content is less than about 5 atom percent and the refractory metal content lies within the limits specified, rapidly quenched ribbons are not totally glassy. Rather, the rapidly quenched ribbons contain crystalline phases, which may comprise a substantial fraction of the material, depending on specific composition. The rapidly quenched ribbons containing crystalline phases or mixtures of both glassy and crystalline phases have inferior mechanical properties, i.e., low tensile strength, and are brittle. Typically, such ribbons, having thicknesses up to 0.0015 inch, will fracture if bent to a radius of curvature less than 100 times the thickness.

When the boron content is greater than about 12 atom percent and the refractory metal content lies within the limits specified, rapidly quenched ribbons, while remaining fully glassy are, nevertheless, more brittle than ribbons having compositions within the scope of the invention. Typically, such ribbons fracture when bent to a radius of curvature less than about 100 times the thickness.

Similarly, for refractory metal concentrations less than or greater than those listed above, compositions containing such low metalloid content do not form glassy alloys at the usual quench rates. While ductile glassy alloys have heretofore been obtained with refractory metal-boron combinations, such alloys have had a higher boron concentration (typically 15 to 25 atom percent) and lower refractory metal concentrations (typically less than about 10 atom percent).

In contrast, when the boron content ranges from about 5 to 12 atom percent, together with about either 25 to 40 atom percent molybdenum or about 13 to 25 atom percent tungsten, balance iron, rapidly quenched ribbons are substantially totally glassy and possess superior mechanical properties, i.e., high tensile strength and ductility. For example, glassy ribbons of the invention can be bent without fracture to a radius of curvature about 10 times the thickness.

Use of refractory metal elements other than molybdenum and tungsten and use of metalloids other than boron in the amounts given do not form ductile glassy alloys at the usual quench rates. For example, replacing boron by carbon or silicon results in the formation of crystalline, rather than glassy, phases.

The purity of all elements is that found in normal commercial practice. However, it is contemplated that minor additions (up to a few atom percent) of other alloying elements may be made without an unacceptable reduction of the desired properties. Such additions may be made, for example, to aid the glass-forming behavior. Such alloying elements include the transition metal elements (Groups IB to VIIB and VIII, Rows 4, 5 and 6 of the Periodic Table, other than the elements mentioned above) and metalloid elements (carbon, silicon, aluminum, and phosphorus).

The thermal stability of a glassy alloy is an important property in certain applications. Thermal stability is characterized by the time-temperature behavior of an alloy, and may be determined in part by differential thermal analysis (DTA). Glassy alloys with similar crystallization behavior as observed by DTA may exhibit different embrittlement behavior upon exposure to the same heat treatment cycle. By DTA measurement, crystallization temperatures $T_c$ can be accurately determined by heating a glassy alloy (at about 20° to 50° C./min) and noting whether excess heat is evolved over a limited temperature range (crystallization temperature) or whether excess heat is absorbed over a particular temperature range (glass transition temperature). In general, the glass transition temperature is near the lowest, or first, crystallization temperature $T_{c1}$ and, as is conventional, is the temperature at which the viscosity ranges from about $10^{13}$ to $10^{14}$ poise.

The glassy alloys of the invention are formed by quenching an alloy melt of the appropriate composition at a rate of at least about $10^{5}$° C./sec. A variety of techniques are available, as is well-known in the art, for fabricating rapidly-quenched continuous filament. Typically, a particular composition is selected, powders of the requisite elements (or of materials that decompose to form the elements) in the desired proportions are melted and homogenized, and the molten alloy is rapidly quenched on a chill surface, such as a rapidly rotating cylinder.

The alloys of the invention are substantially totally glassy, as determined by X-ray diffraction. The term "glassy", as used herein, means a state of matter in which the component atoms are arranged in a disorderly array; that is, there is no long range order. Such a glassy alloy material gives rise to broad, diffuse diffraction peaks when subjected to electromagnetic radiation in the X-ray region (about 0.01 to 50 Å wavelength). This is in contrast to crystalline material, in which the component atoms are arranged in an orderly array, giving rise to sharp diffraction peaks.

The glassy alloys of the invention evidence hardness values of at least about 1300 Kg/mm$^2$, ultimate tensile strengths of at least about 420 Kpsi and crystallization temperatures of at least about 600° C. In the Fe-Mo-B system, decreasing the iron content and increasing the molybdenum content results in an increase in hardness to values approaching 1700 Kg/mm$^2$. Compositions with boron content of about 8 to 10 atom percent are especially ductile. Accordingly, such compositions, which consist essentially of about 8 to 10 atom percent boron, about 30 to 40 atom percent molybdenum and the balance essentially iron plus incidental impurities are preferred. These alloys also evidence excellent fabricability and, in ribbon form, excellent ductility. Examples of such preferred alloys include $Fe_{60}Mo_{30}B_{10}$ and $Fe_{55}Mo_{35}B_{10}$.

In the Fe-W-B system, preferred compositions include those with about 8 to 10 atom percent boron, about 13 to 20 atom percent tungsten and the balance essentially iron plus incidental impurities. These alloys possess excellent ribbon fabricability and ductility. Examples include $Fe_{77}W_{15}B_8$ and $Fe_{77}W_{13}B_{10}$.

The high mechanical strength and high thermal stability of the glassy alloys of the invention renders them suitable for use as reinforcement in composites for high temperature applications.

EXAMPLES

Alloys were prepared from constituent elements of high purity (≧99.9%). The elements with a total weight of 30 g were melted by induction heater in a quartz crucible under vacuum of $10^{-3}$ Torr. The molten alloy was held at 150° to 200° C. above the liquidus temperature for 10 min. and allowed to become completely homogenized before it was slowly cooled to solid state at room temperature. The alloy was fractured and examined for complete homogeneity.

About 10 g of the alloys was remelted to 150° C. above liquidus temperatures under vacuum of $10^{-3}$ Torr in a quartz crucible having an orifice of 0.010 inch diameter in the bottom. The chill substrate used in the present work was heat-treated beryllium-copper alloy having moderately high strength and high thermal conductivity. The substrate material contained 0.4 to 0.7 wt % beryllium, 2.4 to 2.7 wt % cobalt and copper as balance. The substrate was rotated at a surface speed of 4000 ft/min. The substrate and the crucible were contained inside a vacuum chamber evacuated to $10^{-3}$ Torr.

The melt was spun as a molten jet by applying argon pressure of 5 psi over the melt. The molten jet impinged vertically onto the internal surface of the rotating substrate. The chill-cast ribbon was maintained in good contact with the substrate by the centrifugal force acting on the ribbon against the surface. The ribbon was displaced from the substrate by nitrogen gas at 30 psi at a position two-thirds of the circumferential length away from the point of jet impingement. During the metallic glass ribbon casting operation, the vacuum chamber was maintained under a dynamic vacuum of 20 Torr. The substrate surface was polished with 320 grit emery paper and cleaned and dried with acetone prior to the start of the casting operation. The as-cast ribbons were found to have good edges and surfaces. The ribbons had the following dimensions: 0.001 to 0.002 inch thickness and 0.015 to 0.020 inch width.

The degree of glassiness was determined by X-ray diffraction. A cooling rate of at least about $10^{5}$° C./sec was attained by the quenching process.

Hardness was measured by the diamond pyramid technique using a Vickers-type indenter, consisting of a diamond in the form of a square-base pyramid with an included angle of 136° between opposite faces. Loads of 100 g were applied. Crystallization temperature was measured by differential thermal analysis at a scan rate of about 20° C./min. Ultimate tensile strength was measured on an Instron machine using ribbons with unpolished edges. The gauge length of the specimens was 1 inch and the cross-head speed was 0.02 in/min.

The following values of hardness in Kg/mm$^2$, ultimate tensile strength in Kpsi and crystallization temperature in ° C., listed in the Table below, were measured for a number of compositions falling within the scope of the invention.

TABLE

Mechanical and Thermal Properties of Fe-Mo-B and Fe-W-B Glassy Alloys of the Invention

| Composition (atom percent) | Hardness, Kg/mm$^2$ | Ultimate Tensile Strength, Kpsi | Crystallization Temperature, ° C |
|---|---|---|---|
| $Fe_{65}Mo_{25}B_{10}$ | 1308 | 475 | 615,680 |
| $Fe_{60}Mo_{35}B_5$ | 1354 | | |

TABLE-continued

Mechanical and Thermal Properties of Fe-Mo-B and Fe-W-B Glassy Alloys of the Invention

| Composition (atom percent) | Hardness, Kg/mm$^2$ | Ultimate Tensile Strength, Kpsi | Crystallization Temperature, °C |
|---|---|---|---|
| $Fe_{60}Mo_{30}B_{10}$ | 1402 | 486 | |
| $Fe_{55}Mo_{40}B_5$ | 1682 | | |
| $Fe_{55}Mo_{35}B_{10}$ | 1532 | | |
| $Fe_{50}Mo_{38}B_{12}$ | 1589 | | |
| $Fe_{77}W_{15}B_8$ | 1390 | 420 | 658;867 |
| $Fe_{77}W_{13}B_{10}$ | 1330 | | |
| $Fe_{75}W_{20}B_5$ | 1465 | | 625;869 |
| $Fe_{75}W_{13}B_{12}$ | 1315 | | |
| $Fe_{67}W_{25}B_8$ | 1505 | | |

What is claimed is:

1. A substantially totally glassy alloy consisting essentially of about 5 to 12 atom percent boron, a member selected from the group consisting of about 25 to 40 atom percent molybdenum and about 13 to 25 atom percent tungsten and the balance essentially iron plus incidental impurities.

2. The glassy alloy of claim 1 consisting essentially of about 5 to 12 atom percent boron, about 25 to 40 atom percent molybdenum and the balance essentially iron plus incidental impurities.

3. The glassy alloy of claim 2 consisting essentially of about 8 to 10 atom percent boron, about 30 to 40 atom percent molybdenum and the balance essentially iron plus incidental impurities.

4. The glassy alloy of claim 3 having a composition selected from the group consisting of $Fe_{60}Mo_{30}B_{10}$ and $Fe_{55}Mo_{35}B_{10}$.

5. The glassy alloy of claim 1 consisting essentially of about 5 to 12 atom percent boron, about 13 to 25 atom percent tungsten and the balance essentially iron plus incidental impurities.

6. The glassy alloy of claim 5 consisting essentially of about 8 to 10 atom percent boron, about 13 to 20 atom percent tungsten and the balance essentially iron plus incidental impurities.

7. The glassy alloy of claim 6 having a composition selected from the group consisting of $Fe_{77}W_{15}B_8$ and $Fe_{77}W_{13}B_{10}$.

* * * * *